US010619601B2

(12) United States Patent
Yudanov

(10) Patent No.: US 10,619,601 B2
(45) Date of Patent: Apr. 14, 2020

(54) EXHAUST GAS RECIRCULATION ARRANGEMENT

(71) Applicant: VOLVO TRUCK CORPORATION, Göteborg (SE)

(72) Inventor: Sergi Yudanov, Västra Frölunda (SE)

(73) Assignee: VOLVO TRUCK CORPORATION, Göteborg (SE)

( * ) Notice: Subject to any disclaimer, the term of this patent is extended or adjusted under 35 U.S.C. 154(b) by 0 days.

(21) Appl. No.: 15/758,242

(22) PCT Filed: Sep. 11, 2015

(86) PCT No.: PCT/EP2015/070851

§ 371 (c)(1),
(2) Date: Mar. 7, 2018

(87) PCT Pub. No.: WO2017/041857

PCT Pub. Date: Mar. 16, 2017

(65) Prior Publication Data

US 2018/0258888 A1 Sep. 13, 2018

(51) Int. Cl.
*F02M 26/35* (2016.01)
*F02M 26/06* (2016.01)
(Continued)

(52) U.S. Cl.
CPC ..... *F02M 26/35* (2016.02); *F01N 3/005* (2013.01); *F02B 33/44* (2013.01); *F02M 26/06* (2016.02);
(Continued)

(58) Field of Classification Search
CPC ..... F02M 26/35; F02M 26/06; F02M 26/19; F02M 26/42; F02M 26/44; F02M 26/09; F01N 3/005; F02B 33/44
(Continued)

(56) References Cited

U.S. PATENT DOCUMENTS 7,469,691 B2 * 12/2008 Joergl ..... F02D 41/0065 123/568.12
2004/0074480 A1 4/2004 Chen et al.
(Continued)

FOREIGN PATENT DOCUMENTS

CN 102062002 A 5/2011
CN 102588082 A 7/2012
(Continued)

OTHER PUBLICATIONS

International Search Report (dated Jun. 1, 2016) for corresponding International App. PCT/EP2015/070851.
(Continued)

*Primary Examiner* — Mahmoud Gimie
(74) *Attorney, Agent, or Firm* — Venable LLP; Jeffri A. Kaminski

(57) ABSTRACT

An exhaust gas recirculation arrangement is provided for a power system, the power system including an internal combustion engine, an exhaust gas system and an intake system including an inlet air compressor, the exhaust gas recirculation arrangement including a first exhaust gas recirculation path and a second exhaust gas recirculation path for recirculating exhaust gas from the exhaust gas system to the intake system. The first and second exhaust gas recirculation paths are adapted to recirculate exhaust gas to the same side of the inlet air compressor, in an intended direction of flow of inlet air in the power system, wherein the exhaust gas recirculation arrangement includes a flow controller, preferably the flow controller includes a valve connected to the second exhaust gas recirculation path, for controlling the flow volume through at least one of the first and second exhaust gas recirculation paths.

30 Claims, 4 Drawing Sheets

(51) Int. Cl.

| | |
|---|---|
| ***F02B 33/44*** | (2006.01) |
| ***F02M 26/09*** | (2016.01) |
| ***F02M 26/19*** | (2016.01) |
| ***F02M 26/44*** | (2016.01) |
| ***F02M 26/42*** | (2016.01) |
| ***F01N 3/00*** | (2006.01) |

(52) U.S. Cl.
CPC ..... *F02M 26/09* (2016.02); *F02M 26/19* (2016.02); *F02M 26/42* (2016.02); *F02M 26/44* (2016.02)

(58) Field of Classification Search
USPC ..... 123/568.11, 568.12
See application file for complete search history.

(56) References Cited

U.S. PATENT DOCUMENTS

| | | | | |
|---|---|---|---|---|
| 2007/0144501 | A1 | 6/2007 | Joergl et al. | |
| 2009/0000297 | A1 | 1/2009 | Joergl et al. | |
| 2009/0241515 | A1 | 10/2009 | Cardno | |
| 2011/0114066 | A1* | 5/2011 | Vasallo | F02D 41/0007 123/564 |

FOREIGN PATENT DOCUMENTS

| | | | |
|---|---|---|---|
| CN | 104608594 | A | 5/2015 |
| EP | 2112364 | A1 | 10/2009 |
| GB | 2088476 | A | 6/1982 |
| JP | 2013-147988 | A | 8/2013 |
| WO | 2013017660 | A1 | 2/2013 |
| WO | 2015091388 | A1 | 6/2015 |

OTHER PUBLICATIONS

European Office Action dated Jan. 1, 2020 in corresponding EP Application No. 15760205.3, 5 pages.
Chinese Office Action dated Dec. 2, 2019 in corresponding CN Application No. 201580082896.5, 21 pages.

* cited by examiner

EXHAUST GAS RECIRCULATION ARRANGEMENT

BACKGROUND AND SUMMARY

The present disclosure relates to an exhaust gas recirculation arrangement. Furthermore, the present disclosure relates to a method for recirculating exhaust gas to an air intake of a power system comprising an internal combustion engine. Additionally, the present disclosure relates to a computer program and/or a control unit.

The present disclosure can be applied in heavy-duty vehicles, such as trucks, buses and construction equipment. Although the invention will be described with respect to a truck, the invention is not restricted to this particular vehicle, but may also be used in other vehicles such as a bus, a work machine or the like.

A power system, for instance a power system for a vehicle, generally has an internal combustion engine (ICE), an exhaust gas system and an intake system. Furthermore, in order to reduce $NO_x$, emissions, a modern power system may also include an exhaust gas recirculation arrangement that feeds a portion of the exhaust oases from the exhaust gas system to the intake system. Such exhaust gas recirculation (EGR) arrangements exist in many different versions, devised to cope with the demanding, and often conflicting requirements imposed upon ICE in their frequently varying operating conditions and by the multitude of purposes that the engines are used for. Among these require tents, one of the most important concerns maintaining a high engine efficiency. At the same time, durability and reliability of a power system are always in focus.

Most modern compression ignition engines, which are used almost exclusively in commercial transport and machinery, make use of turbochargers for higher specific power and reduced fuel consumption. It is known that as regards engine efficiency effect of an exhaust gas recirculation system, it is often an advantage to be able to utilize a so-called "Tong Route EGR" or low-pressure EGR, when the exhaust gas is taken downstream the turbo part of the turbocharger for feeding back to the engine's intake. However, depending on the operating condition of the power system arranged in this way, there may be a risk that liquid droplets, e.g. water droplets, be formed in the exhaust gas recirculation arrangement. Such liquid droplets may impair a portion of the intake system, such as an inlet, air compressor.

In order to mitigate the damaging effect of the liquid droplets, US 2009/0000297 A1 proposes that an, exhaust gas recirculation arrangement be furnished with a condensation separation apparatus separating moisture from that exhaust gas. The thus separated moisture is thereafter directed towards the centre of an intake compressor wheel. Although the US 2009/0000297 A1 exhaust gas recirculation arrangement may result in reduced erosion of a compressor wheel of an intake system, the arrangement may also require a relatively large pressure difference over the arrangement in order for the condensation separation apparatus to be able to operate in a satisfactory manner. Such a large pressure difference may in turn have a negative effect on the engine efficiency.

It is desirable to provide an exhaust gas recirculation arrangement that can mitigate the damaging effect of the liquid droplets possibly formed in the arrangement, in a way that is advantageous for engine efficiency.

As such, the present disclosure relates to an exhaust gas recirculation arrangement for a power system. The power system comprises an internal combustion engine, an exhaust gas system and an intake system comprising an inlet air compressor. The exhaust gas recirculation arrangement comprises a first exhaust gas recirculation path and a second exhaust gas recirculation path for recirculating exhaust gas from the exhaust gas system to the intake system.

Furthermore, according to the present disclosure, the first and second exhaust gas recirculation paths are adapted to recirculate exhaust gas to the same side of the inlet air compressor, in an intended direction of flow of inlet air in the power system. Moreover, the exhaust gas recirculation arrangement comprises a flow controller, preferably the flow controll e comprises a valve connected to the second exhaust gas recirculation path, for controlling the flow volume through at least one of the first and second exhaust gas recirculation paths.

By the provision of an exhaust gas recirculation arrangement that comprises the above-mentioned flow controller, it is possible to selectively control the flow volume of exhaust gas through either one, or both, of the exhaust gas recirculation paths. This in turn implies that one of the exhaust gas recirculation paths can be adapted for handling exhaust gas having a high probability of containing liquid droplets whereas the other recirculation path can be adapted for enabling an appropriate engine efficiency.

Thus, the provision of the two exhaust gas recirculation paths and the flow controller implies that appropriate amounts of exhaust gas may be fed through the respective exhaust gas recirculation path, depending on the operating condition of the power system.

Optionally, the exhaust gas recirculation arrangement comprises a sensor adapted to determine a power system characteristic parameter. The exhaust gas recirculation arrangement is adapted to control the flow controller in response to the power system characteristic parameter.

The above-mentioned sensor implies an appropriate means for determining a relevant power system characteristic which it turn implies an appropriate control of the flow volumes.

Optionally, the power system characteristic parameter is indicative of at least the temperature of the internal combustion engine and/or the liquid content in the exhaust gas produced by the internal combustion engine and/or the liquid content in fluid removed from the exhaust gases by the exhaust gas recirculation arrangement.

A power system characteristic parameter indicative of any one of the above conditions may be suitable for determining how to control the flow volumes through the first and second exhaust vas recirculation paths.

Optionally, the first and second exhaust gas recirculation paths are non-identical. This implies an appropriate possibility to adopt an appropriate flow volume control. The first and second exhaust gas recirculation paths may be non-identical in a plurality of ways. Purely by way of example, the first and second exhaust gas recirculation paths may be physically different, e.g. having different lengths and/or cross-sectional areas. Moreover, the first and second exhaust gas recirculation paths may discharge exhaust gases at different positions and/or in different directions in the intake system.

Optionally, in use, the first exhaust gas recirculation path is associated with a first liquid removal capability and the second exhaust gas recirculation path is associated with a second liquid removal capability, the first liquid removal capability being higher than the second liquid removal capability. In other words, if gas with the same liquid content is fed from the exhaust gas system to the intake system via the first and second exhaust gas recirculation paths, the gas that exits the first exhaust gas recirculation paths will generally have a lower liquid content than the gas exiting the second exhaust gas recirculation paths.

The different liquid removal capabilities imply a possibility to control the flow volume through an exhaust gas recirculation path with an appropriate liquid removal capability, e.g. depending on characteristics of the exhaust gas circulated. Purely by way of example, the second liquid removal capability may be zero or close to zero indicating that the second exhaust gas recirculation path is associated with no. or at least a limited, liquid removal capability.

Optionally, the exhaust gas recirculation arrangement comprises a liquid separator comprising a first and a second gas outlet, the first gas outlet being in fluid communication with the first exhaust gas recirculation path and the second gas outlet being in fluid communication with the second exhaust gas recirculation path.

Having a separator with two outlets implies that the two exhaust gas recirculation paths can be associated with different liquid removal capabilities in a compact manner.

Optionally, the liquid separator comprises a liquid collecting portion and the sensor is located in the liquid collecting portion.

The amount of liquid that is located in, or passes, the liquid collecting portion may be indicative of the liquid content in the exhaust gases. Thus, placing a liquid separator in the liquid collecting portion implies that relevant information as regards the characteristics of the exhaust gas may be determined.

Optionally, the liquid separator comprises a labyrinth section comprising an interior labyrinth portion in fluid communication with the first gas outlet. The labyrinth section implies that the first exhaust gas recirculation path may be associated with a relatively large liquid removal capability.

Optionally, the exhaust gas recirculation arrangement comprises an exhaust gas recirculating conduit adapted to fluidly connect a recirculation inlet, connectable to the exhaust gas system, to the liquid separator.

Optionally, the exhaust gas recirculation arrangement comprises an exhaust gas recirculating cooler located between the recirculation inlet and the liquid separator, as seen in a direction of flow from the recirculation inlet to the liquid separator.

Optionally, the exhaust gas recirculation arrangement further comprises a separator drain conduit adapted to provide a fluid communication between the liquid separator and a drain outlet, connectable to the exhaust gas system. The drain outlet is adapted to be located downstream the recirculation inlet in an intended direction of exhaust gas flow in the exhaust gas system.

The separator drain conduit implies that liquid separated from the recirculated exhaust gases may be fed to the exhaust gases that will not be recirculated. As such, by virtue of the above-mentioned drain conduit separated liquid may be discharged to ambient environment via the exhaust gas system and this in turn implies that the system need not have a separate vessel, such as a tank, for storage of separated liquid.

Optionally, the separator drain conduit comprises a restrictor, preferably the restrictor has a restriction being at least twice the restriction of the first exhaust gas recirculation path.

Optionally, the sensor is located in the separator drain conduit.

Optionally, the exhaust gas recirculation arrangement further comprises a drain check valve for allowing drain flow from the separator to the drain outlet and preventing flow in the opposite direction.

Optionally, the inlet air compressor comprises a radial centre and the first exhaust gas recirculation path is adapted to discharge exhaust gas towards the radial centre. If exhaust gas is directed towards the radial centre of the inlet air compressor, the risk that the flow of exhaust gases will damage, for instance by erosion, the inlet air compressor is relatively low, even if the exhaust gases has a relatively large liquid content.

Optionally, the inlet air compressor comprises a receiving area exposable to inlet air. The first exhaust gas recirculation path being adapted to discharge exhaust gas towards a limited portion, preferably 30% or less, more preferred 15% or less, of the receiving area.

A second aspect of the present disclosure relates to a power system comprising an internal combustion engine and an exhaust gas recirculation arrangement according to the first aspect of the present disclosure.

Optionally, the power system further comprises the exhaust gas system, wherein exhaust gas is adapted to be fed from an exhaust gas feeding portion of the exhaust gas system to the exhaust gas recirculation arrangement. The exhaust gas system further comprises an exhaust pressure governor located downstream of the exhaust gas feeding portion.

Optionally, the exhaust gas system comprises a liquid receiving portion adapted to receive liquid separated by the exhaust gas recirculation arrangement, the liquid receiving portion being located downstream of the exhaust pressure governor.

Optionally, the power system comprises the intake system. The intake system comprises an exhaust gas receiving portion adapted to receive exhaust gas from the first and second exhaust gas recirculation paths. The intake system further comprises an intake flow control valve located upstream the exhaust gas receiving portion.

A third aspect of the present disclosure relates to a vehicle comprising the power system according to the second aspect of the present disclosure and/or an exhaust gas recirculation arrangement according to the first aspect of the present disclosure.

A fourth aspect of the present disclosure relates to a method for recirculating exhaust gas to an air intake of a power system comprising an internal combustion engine, the power system comprises an internal combustion engine, an exhaust gas system and an intake system comprising an inlet air compressor, using a first exhaust gas recirculation path and a second exhaust gas recirculation path. Each one of the first and second exhaust gas recirculation paths is adapted to return exhaust gas to the same side of the inlet air compressor.

The method comprises recirculating exhaust gas from the exhaust gas system to the intake system via at least one of the first and second exhaust gas recirculation paths. Moreover, the method further comprises controlling the flow volume of exhaust gas through at least one of the first and second exhaust gas recirculation paths.

Optionally, the first exhaust gas recirculation path is associated with a first liquid removal capability and the second exhaust gas recirculation path is associated with a second liquid removal capability. The first liquid removal capability is higher than the second liquid removal capability.

Optionally, the method further comprises:

a. determining a power system characteristic parameter and b. controlling the flow volume of exhaust gas through at least one of the first and second exhaust gas recirculation paths (14, 16) in response to the power system characteristic parameter.

Optionally, the power system characteristic parameter is indicative of at least the temperature of the internal combustion engine and/or the liquid content of the exhaust gas produced by the internal combustion engine and/or the liquid content in fluid removed from the exhaust gases.

Optionally, the method further comprises determining a likelihood of formation of liquid in a portion of the power system, preferably in a liquid separator and/or in a drain conduit of the power system, using the power system characteristic parameter.

Optionally, the method further comprises closing the flow through the second exhaust gas recirculation path (16) if the likelihood of formation of liquid in a portion of the power system exceeds a predetermined threshold level.

Optionally, the method further comprises draining liquid removed from the exhaust vases to a drain outlet located in the exhaust gas system. The method further comprises controlling the exhaust gas pressure upstream the drain outlet such that the exhaust gas pressure exceeds the pressure at the drain outlet by a predetermined amount.

Optionally, the exhaust gas system comprises an exhaust pressure governor and the intake system comprises an intake flow control valve, wherein a predetermined exhaust recirculation flow is achieved by a combined governing of the exhaust pressure governor and the intake flow control valve. The combined governing is controlled for achieving a fuel consumption below a predetermined fuel consumption level.

A fifth aspect of the present disclosure relates to a computer program comprising program code means for performing the steps of the fourth aspect of the present disclosure.

A sixth aspect of the present disclosure relates to a computer readable medium carrying a computer program comprising program code means for performing the steps of the fourth aspect of the present disclosure when the program product is run on a computer.

A seventh aspect of the present disclosure relates to a control unit fir controlling exhaust gas recirculation to an air intake of a power system, the control unit being configured to perform the steps of the fourth aspect of the present disclosure.

Further advantages and advantageous tenures of the invention are disclosed in the following description and in the dependent claims.

BRIEF DESCRIPTION OF THE DRAWINGS

With reference to the appended drawings, below follows a more detailed description of embodiments of the invention cited as examples.

In the drawings.

It should be noted that the appended drawings are not necessarily drawn to scale and that the dimensions of some features of the present invention may have been exaggerated for the sake of clarity.

DETAILED DESCRIPTION

The invention will below be described for a vehicle in the form of a truck 10 such as the one illustrated in FIG. 1. The truck 10 should be seen as an example of a vehicle which could comprise an exhaust gas recirculation arrangement and or power system according to the present invention. However, the exhaust gas recirculation arrangement anal or power system of the present invention may be implemented in a plurality of different types of objects, e.g. other types of vehicles. Purely by way of example, the exhaust gas recirculation arrangement and/or power system could be implemented in a truck, a tractor, a car, a bus, a work machine such as a wheel loader or an articulated hauler or any other type of construction equipment. The FIG. 1 truck 10 comprises a power system 12.

The power system 12 may be powered by a high-volatility fuel, such as dimethyl ether (DME) or a blend comprising dimethyl ether. Although the power system 12 may be adapted to be powered by e.g. DME, it is also envisaged that the power system may be powered by another type of fuel, such as diesel or naphtha.

Figure 1:
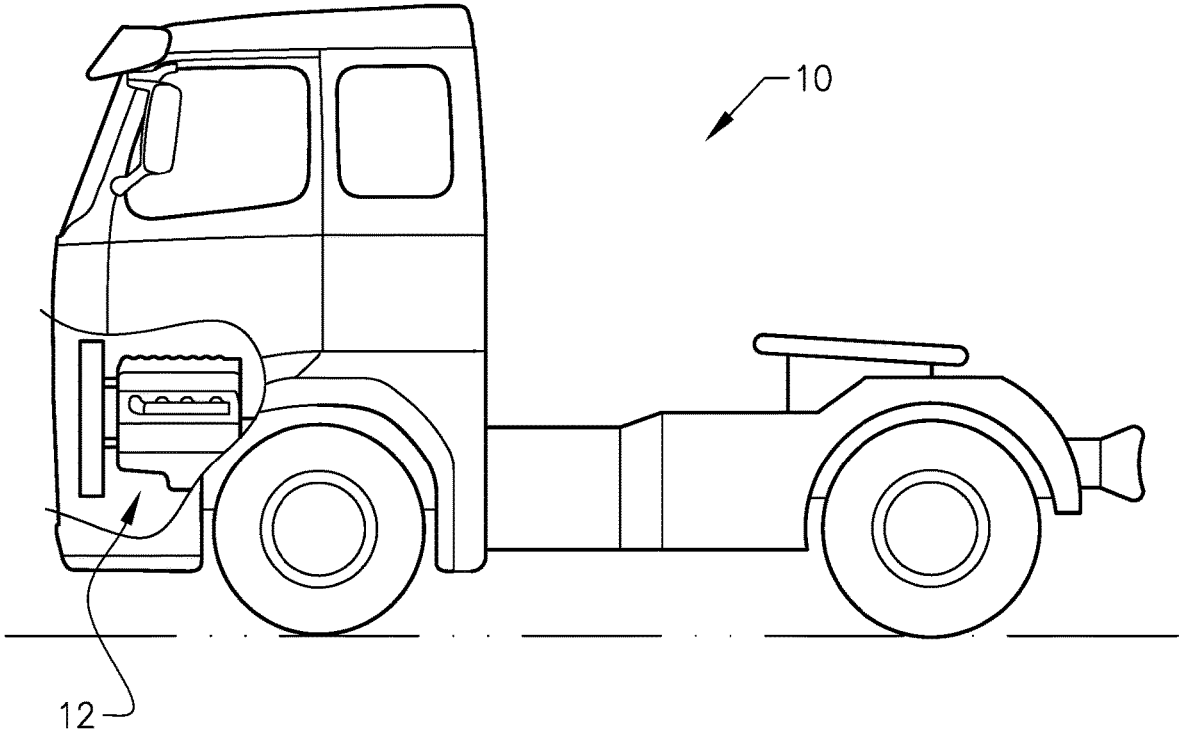
FIG. 1 illustrates a truck comprising a power system.
Figure 2:
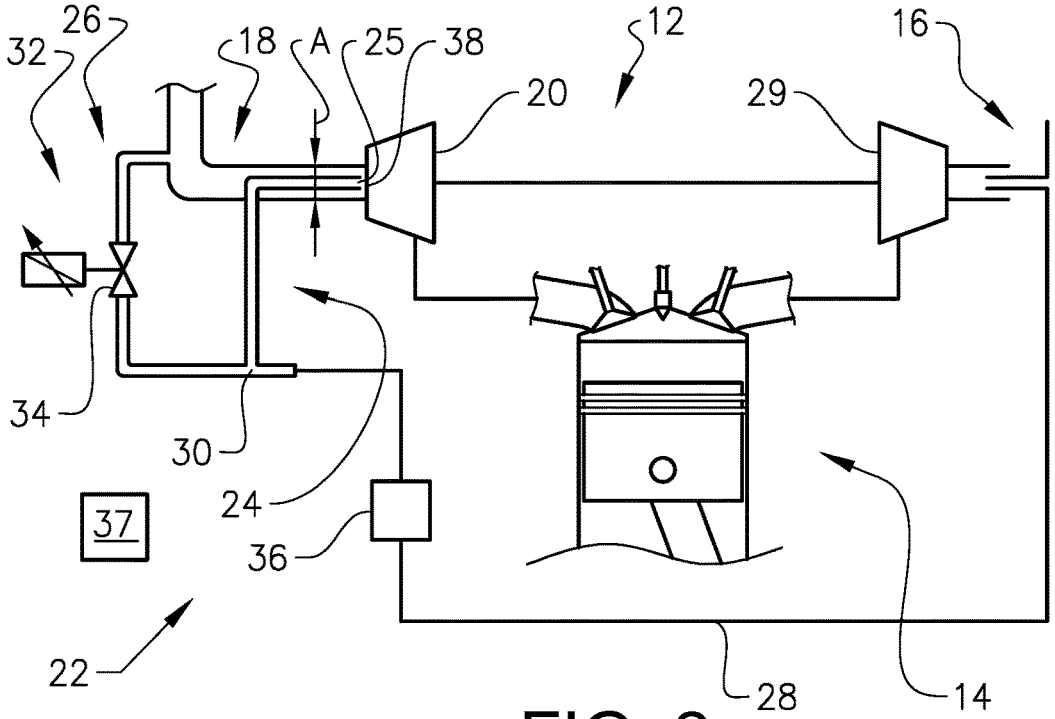
FIG. 2 illustrates a power system comprising an embodiment of an exhaust gas recirculation arrangement 22.

FIG. 2 schematically illustrates a power system 12 which could be included in a vehicle (not shown in FIG. 2) such as the FIG. 1 truck. As may be gleaned from FIG. 2, the power system 12 comprises an internal combustion engine 14, an exhaust gas system 16 and an intake system 18 comprising an inlet air compressor 20.

FIG. 2 further illustrates an exhaust gas recirculation arrangement 22 for the power system 12. Furthermore, FIG. 2 illustrates that the exhaust gas recirculation arrangement 22 comprises a first exhaust gas recirculation path 24 and a second exhaust gas recirculation path 26 for recirculating exhaust gas from the exhaust gas system 16 to the intake system 18.

In the embodiment illustrated in FIG. 2, the first exhaust gas recirculation path 24 and the second exhaust gas recirculation path 26 are in fluid communication with an exhaust pas recirculating conduit 28 extending from the exhaust gas system 16 to a conduit branch portion 30 from which each one of the first and second exhaust gas recirculation paths 24, 26 extends to the intake system 18. However, it is also envisaged that the first and second exhaust gas recirculation paths 24, 26 may be formed by separate conduits or conduit assemblies each one of which extending Irony the exhaust gas system 16 to the intake system 18. As a general remark, the exhaust gas recirculation arrangement 22 may be such that at least one of the first and second exhaust was recirculation paths 24, 26 has a portion m which fluid guided thereto cannot be mixed with exhaust gas from the other exhaust gas recirculation path.

Furthermore, as may be gleaned from FIG. 2, the first and second exhaust gas recirculation paths 24, 26 are adapted to recirculate exhaust gas to the same side of the inlet air compressor 20, in an intended direction of flow of inlet air in the power system 12. In the embodiment illustrated in FIG. 2, each one of the recirculation paths 24, 26 are adapted to recirculate exhaust gas to upstream side of the inlet air compressor 20. Moreover, in FIG. 2, the exhaust gas recirculating conduit 28 extends from a position downstream of a turbine 29 of the exhaust gas system 16. As such, in the FIG. 2 embodiment, the first and second exhaust gas recirculation paths 24, 26 form part of a low pressure exhaust gas recirculation arrangement 22.

Moreover, the exhaust gas recirculation arrangement 22 comprises a flow controller 32 for controlling the flow volume through at least one of the first and second exhaust gas recirculation paths 24, 26, In the implementation illustrated in FIG. 2, the flow controller 32 comprises a valve 34 connected to the second exhaust gas recirculation path 34.

In the FIG. 2 embodiment, the second exhaust gas recirculation path 26 has a cross-sectional area that is larger than the cross-sectional area of the first exhaust gas recirculation path 24, Thus, in use, the pressure difference over the second exhaust gas recirculation path 26 is generally lower than the pressure difference over the first exhaust gas recirculation path 24. As a consequence of the lower pressure difference over the second exhaust gas recirculation path 26, when the valve 34 is open, exhaust gas tends to flow through the second exhaust gas recirculation path 26 rather than the first exhaust gas recirculation path 24. As such, a single valve 34, such as the one illustrated in FIG. 2, may be sufficient for selectively controlling the flow volume through the first and second exhaust gas recirculation paths 24, 26.

The flow controller 32 may be operable so as to selectively control the flow volume of exhaust gas through either one, or both, the exhaust gas recirculation paths 24, 6, for instance depending on a detected operating condition of the power system 12.

As a non-limiting example, the exhaust gas recirculation arrangement 22 may comprise a sensor 36 adapted to determine a power system characteristic parameter. Moreover, the exhaust gas recirculation arrangement 22 may be adapted to control the flow controller 32 in response to the power system characteristic parameter. Although FIG. 2 illustrates an embodiment in which a sensor 36 is located in the exhaust gas recirculating conduit 28, it is also envisaged that other embodiments instead or in addition comprise a sensor in another location such as the exhaust gas system 16. This will be discussed further hereinbelow in relation to the presentation of further embodiments.

Purely by way of example, the power system characteristic parameter may be indicative of at least the temperature of the internal combustion engine and/or the liquid content in the exhaust gas produced by the internal combustion engine and/or the liquid content in fluid removed from the exhaust gases by the exhaust gas recirculation arrangement.

As a non-limiting example, e.g. a determination of the power system characteristic parameter and/or a selective flow volume control through the exhaust gas recirculation paths 24, 26 may at least be partially performed by a control unit 37.

FIG. 2 farther illustrates an embodiment of the exhaust gas recirculation arrangement 22 wherein the first and second exhaust gas recirculation paths 24, 26 are non-identical. As has been indicated above, the first and second exhaust gas recirculation paths 24, 26 are non-identical since they have different cross-sectional areas. Moreover as may be gleaned from FIG. 2 the exhaust gas recirculation paths 24, 26 are assigned different positions in the intake system 18 at which exhaust gas is discharged.

As a non-limiting example, the first exhaust gas recirculation path 24 may be adapted to discharge exhaust gas closer to the inlet air compressor 20 than the second exhaust gas recirculation path 26.

Moreover, and as is also disclosed in the FIG. 2 embodiment, the inlet air compressor 20 comprises a radial centre 38 and the first exhaust gas recirculation path 24 may be adapted to discharge exhaust gas towards the radial centre 38. Moreover, though purely by way of example, the inlet air compressor comprises a receiving area A exposable to inlet air. The first exhaust gas recirculation path may be adapted to discharge exhaust gas towards a limited portion, preferably 30% or less, more preferred 15% or less, of the receiving area A. To this end, an outlet 25 of first exhaust gas recirculation path 24 may have a cross-sectional area within any one of the above discussed area ranges.

On the other hand, the second exhaust gas recirculation path 26 in the FIG. 2 embodiment has a relatively large conduit opening thereby enabling the exhaust gases discharged from the second exhaust gas recirculation path 26 to be dispersed before reaching the inlet air compressor 20. This in rum implies that a relatively even mixture of exhaust gas and inlet air reaches the internal combustion engine 14.

With an exhaust gas recirculation arrangement 22 such as the one illustrated in FIG. 2, it is possible to selectively control the flow volume through the first and second exhaust gas recirculation paths 24, 26 depending on e.g. a determined risk level for liquid particle formation in the exhaust gas entering the intake system 18. For instance, if a large risk of liquid particle formation is determined, the flow controller 32 may be controlled so as to allow a relatively large flow volume through the first exhaust gas recirculation, path 24, for instance the valve 34 may be partially or fully closed, such that possible liquid droplets impinge upon and around the radial centre 38 of the inlet air compressor 20 instead of on the relatively vulnerable wheel blades and thus have low erosive effect on the inlet air compressor 20. The radial centre 38 may be designed in such a way that it assists leading the EGR stream on and then around the centre out to the periphery of the impeller wheel smoothly, in order to further reduce the angle of impact of the droplets with the blades and also to reduce flow restriction.

On the other hand, if a low risk of liquid particle formation is determined, the flow controller 32 may be controlled so as to allow a relatively large flow volume through the second exhaust gas recirculation path 26 instead, for instance the valve may 34 partially or fully open, in order to enable a relatively large flow volume through the exhaust gas recirculation arrangement 22 and possibly also provide an appropriate exhaust gas dispersion. Such relatively large flow volume and/or dispersion imply an appropriate $NO_x$ reduction.

Figure 3:
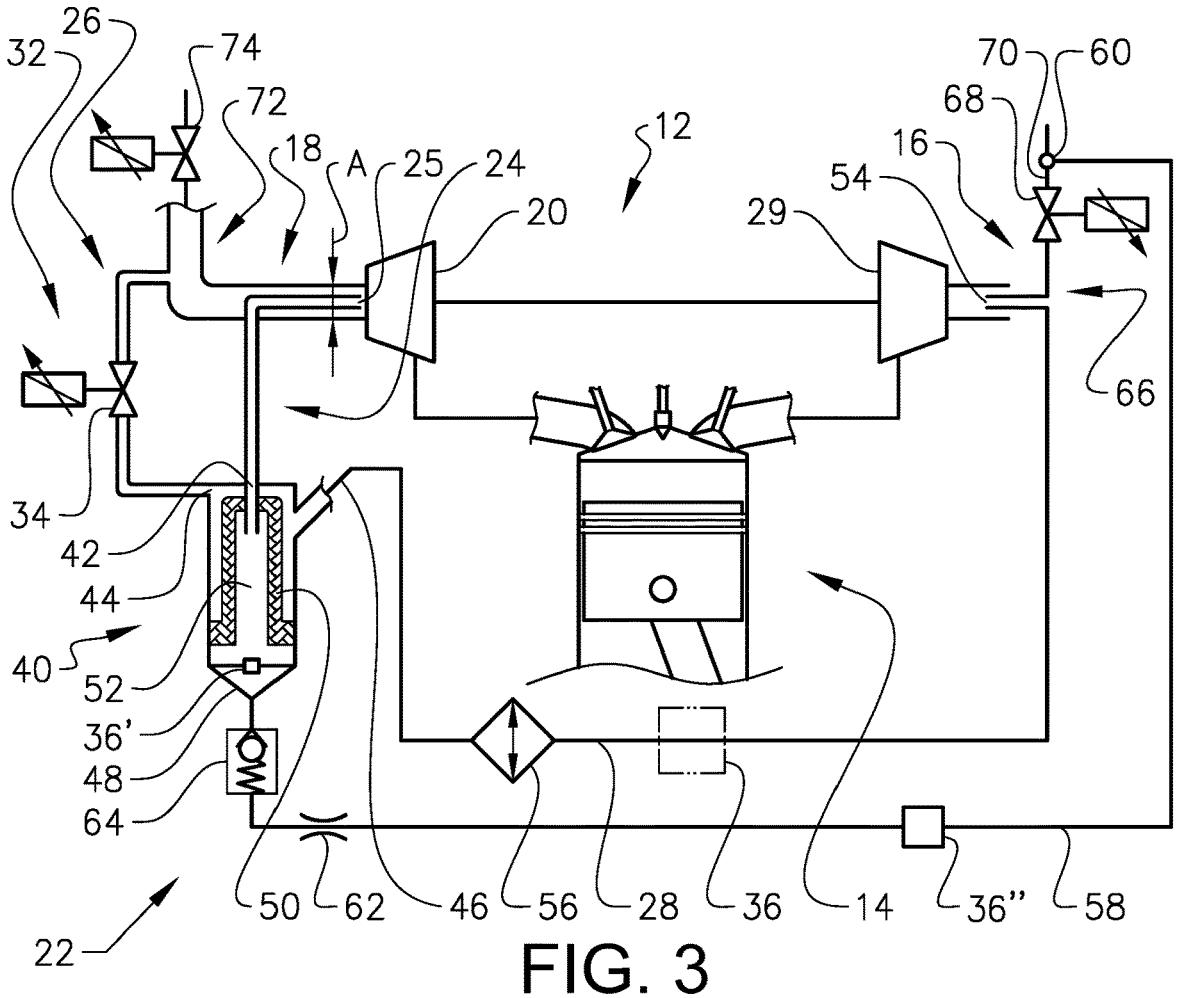
FIG. 3 illustrates a power system comprising another embodiment of an exhaust gas recirculation arrangement 22.

FIG. 3 illustrates another embodiment of an exhaust gas recirculation arrangement 22. In the FIG. 3 embodiment, the first exhaust gas recirculation path 24 is associated with a first liquid removal capability and the second exhaust gas recirculation path 26 is associated with a second liquid removal capability, the first liquid removal capability being higher than the second liquid removal capability. In other words, if gas with the same liquid content is fed from the exhaust gas system 16 to the intake system 18 via the first and second exhaust gas recirculation paths 24, 26, the gas that exits the first exhaust gas recirculation paths 24 generally have a lower liquid content than the gas exiting the second exhaust gas recirculation paths 26.

In the FIG. 3 embodiment, the liquid removal capabilities are at least partially enabled by the fact that the illustrated exhaust gas recirculation arrangement 22 comprises a liquid separator 40 comprising a first 42 and a second 44 gas outlet. The first gas outlet is in fluid communication with the first exhaust gas recirculation 24 path and the second gas outlet 44 is in fluid communication with the second exhaust gas recirculation path 26.

The first 42 and a second 44 gas outlet, are associated with different liquid removal capabilities wherein the liquid removal capability associated with the first gas outlet 42 is larger than the liquid removal capability associated with the second gas outlet 44. As such, if gas with a certain liquid content is fed to the liquid separator 40, the gas that exits the first gas outlet 42 will generally have a lower liquid content than the gas exiting the second gas outlet 44.

The implementation of the liquid separator 40 illustrated in FIG. 3 comprises a liquid collecting portion 48 in which liquid may be collected. Moreover, in the FIG. 3 embodiment, a sensor 36' adapted to determine a power system characteristic parameter may be located in the liquid collecting portion 46, The sensor 36' located in the liquid collecting portion 48 may be employed instead of, or in addition to, the previously discussed sensor 36 which may be located in the exhaust gas recirculating conduit 28. Purely by way of example, the sensor 36' located in, the liquid collecting portion 48 may be adapted to determine a parameter indicative of a flow volume of liquid separated by the liquid separator 40.

Additionally, the FIG. 3 implementation of the liquid separator 40 comprises a labyrinth section 50 comprising an interior labyrinth portion 52 in fluid communication with the first gas outlet 42.

Moreover, in the embodiment of the exhaust gas recirculation arrangement 22 illustrated in FIG. 3 also comprises an exhaust gas recirculating, conduit 28 adapted to fluidly connect a recirculation inlet 54, connectable to the exhaust gas system 16, to the liquid separator 40. Further, in the FIG. 3 embodiment, the exhaust gas recirculation arrangement 22 comprises an exhaust spas recirculating cooler 56 located between the recirculation inlet and the liquid separator, as seen in a direction of flow from the recirculation inlet to the recirculation to the liquid separator.

Additionally, the FIG. 3 embodiment of the exhaust gas recirculation arrangement 22 further comprises a separator drain conduit 58 adapted to provide a fluid communication between the liquid separator 40 and a drain outlet 60, connectable to the exhaust gas system 16. The drain outlet 60 is adapted to be located downstream the recirculation inlet 54 in an intended direction of exhaust gas flow in the exhaust gas system 16.

As may be gleaned from FIG. 3, the separator drain conduit SS may comprise a restrictor 62. As a non-limiting example, the restrictor 62 may have a restriction that is at least twice the restriction of the first exhaust gas recirculation path 24. In other words, the cross-sectional area of the smallest opening of the restrictor is equal to or smaller than the smallest cross-sectional area of the first exhaust gas recirculation path 24.

In the FIG. 3 embodiment, a sensor 36" is located in the separator drain conduit 58, Purely by way of example, such a separator drain conduit sensor 36" may be adapted to determine a parameter indicative of the flow volume through the separator drain conduit 58. The separator drain conduit sensor 36" may be instead of, or in addition to, one or more of the previously discussed sensors 36, 36'.

Purely by way of example, and as is indicated in the FIG. 3 embodiment, the exhaust gas recirculation arrangement 22 may further comprise a drain check valve 64 for allowing drain flow from the liquid separator 40 to the drain outlet 60 and preventing flow in the opposite direction.

FIG. 3 also discloses an embodiment of the power system 12 wherein exhaust gas is adapted to be fed from an exhaust gas feeding portion 66 of the exhaust gas system to the exhaust gas recirculation arrangement 22. Moreover, as is indicated in FIG. 3, the exhaust gas system 16 of the illustrated embodiment of the power system 12 further comprises an exhaust Pressure governor 68 located downstream of the exhaust gas feeding portion 66.

Additionally, the exhaust gas system 16 of the FIG. 3 embodiment of the power system 12 comprises a liquid receiving portion 70 adapted to receive liquid separated by the exhaust gas recirculation arrangement 22. The liquid receiving portion 70 is located downstream of the exhaust pressure governor 68.

Moreover, in the embodiment of the power system 12 illustrated in FIG. 3, the intake system 18 comprises an exhaust gas receiving portion 72 adapted to receive exhaust gas from the first and second exhaust gas recirculation paths 24, 26. The intake system further comprises an intake flow control valve 74 located upstream the exhaust gas receiving portion 72.

Figure 4:
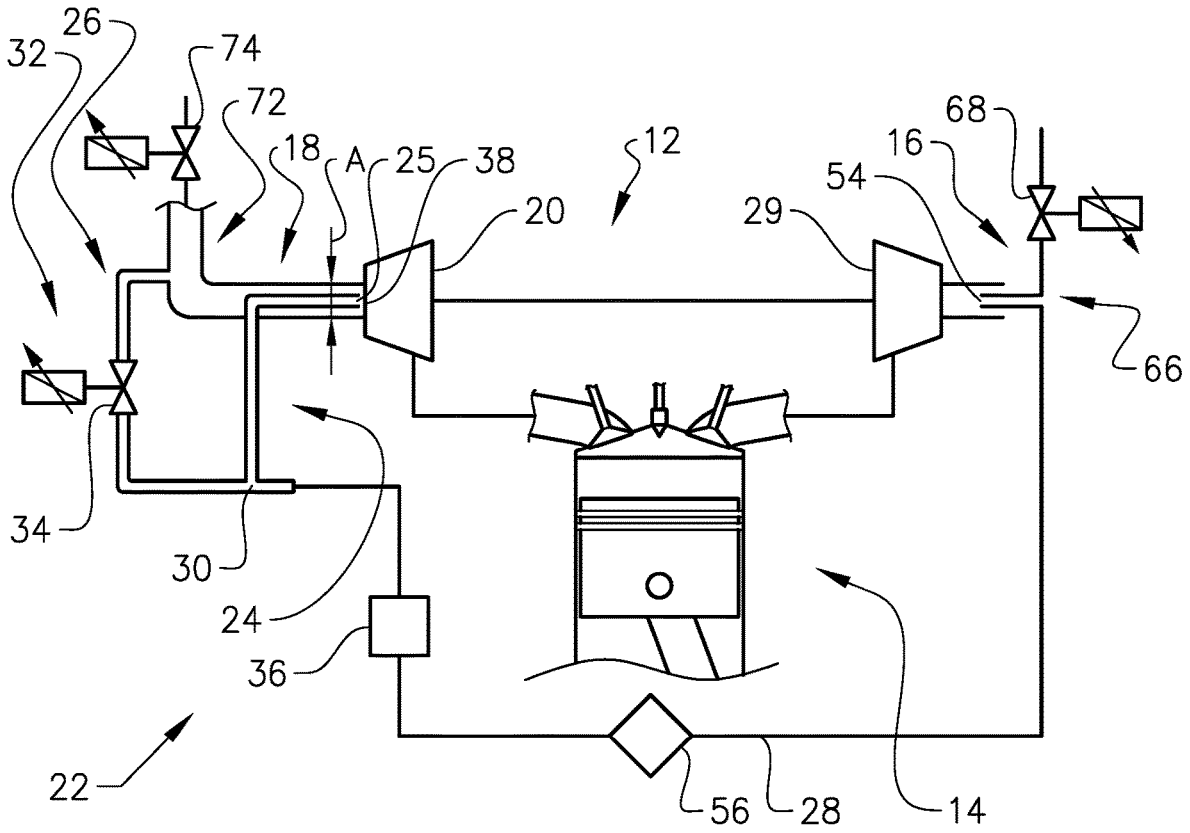
FIG. 4 illustrates a power system comprising a further embodiment of an exhaust gas recirculation arrangement 22.

FIG. 4 illustrates an embodiment of a power system 12 with the FIG. 2 embodiment of the exhaust gas recirculation arrangement 22 and above discussed features of the exhaust gas system 16 and the intake system 18.

Moreover, for an embodiment of the exhaust gas recirculation arrangement 22 in which the first exhaust gas recirculation path 24 is adapted to discharge exhaust gas towards said radial centre 38 of the inlet air compressor 20, the first exhaust gas recirculation path 24 may also be used for distributing a cleaning agent to the inlet air compressor 20.

Figure 5:
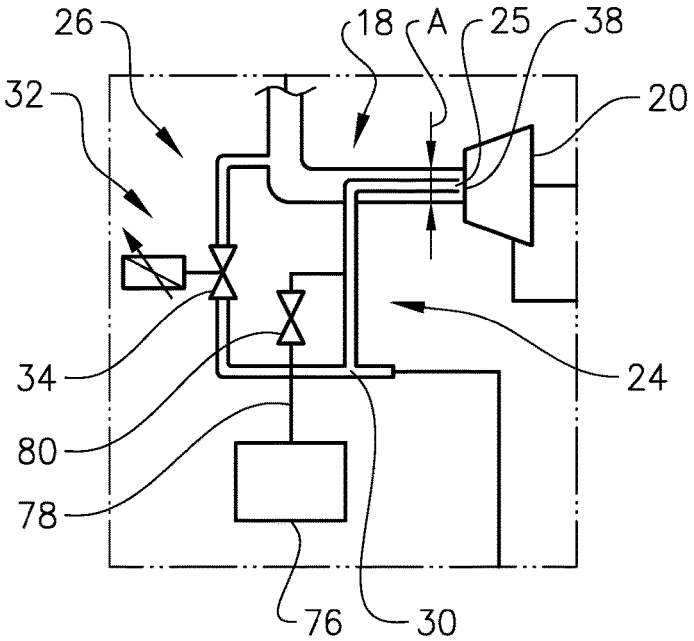
FIG. 5 illustrates an implementation of a first exhaust gas recirculation path.

To this end, an implementation of the first exhaust gas recirculation path 24 is illustrated in FIG. 5. It should be noted that the FIG. 5 implementation may be used in any one of the embodiments of the exhaust gas recirculation arrangements discussed hereinabove with reference to FIG. 2 to FIG. 4.

As may be gleaned from FIG. 5, the embodiment of the exhaust gas recirculation arrangement 22 illustrated therein comprises a source 76 of cleaning agent. Purely by way of example, and as is illustrated in FIG. 5, the source of cleaning agent may comprise a tank adapted to accommodate the cleaning agent. Moreover, the FIG. 5 exhaust gas recirculation arrangement 22 comprises a cleaning agent conduit 78 adapted to provide a fluid communication between the cleaning agent source 76 and the first exhaust gas recirculation path 24. Moreover, a cleaning agent valve 80 controls the flow volume of cleaning agent through the cleaning agent conduit 78.

By virtue of the cleaning agent source 76, the cleaning agent conduit 78 and the cleaning agent valve 80, a cleaning agent may be distributed to the inlet air compressor 20 via the first exhaust gas recirculation path 24. As has been intimated hereinabove, the first exhaust gas recirculation path 24 may be adapted to discharge fluid at a position close to the centre of the inlet air compressor 20. Consequently, the implementation illustrated in FIG. 5 implies that the cleaning agent also may be discharged to the centre of the compressor 20. This in turn implies that that the cleaning agent may be distributed to the compressor 20 in a manner associated with a low risk of damaging e.g. blades (not shown) of the compressor 20.

Thus, the FIG. 5 implementation implies that a cleaning agent may be distributed to the compressor 20 when the compressor is rotating. As such, by virtue of the FIG. 5 implementation, the compressor 20 may be cleaned without having to stop to the power system 12 and/or to disassemble the intake system 18.

Purely by way of example, the cleaning agent may be distributed with exhaust gas in the first exhaust gas recirculation path 24. As another option, the cleaning agent alone may be distributed to the compressor 20.

Figure 6:
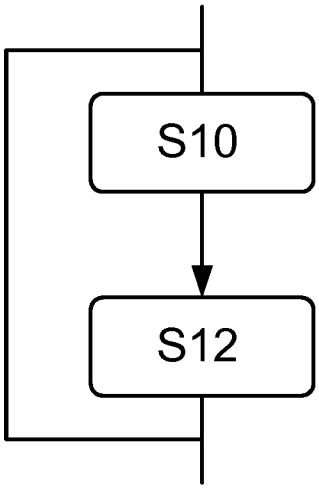
FIG. 6 is a flow chart of an embodiment of a method of the invention.

A fourth aspect of the present disclosure relates to a method for recirculating exhaust gas 16 to an air intake 18 of a power system 12 comprising an internal combustion engine 14, using a first exhaust gas recirculation path 24 and a second exhaust gas recirculation path 26. A flow chart of the above discussed method is presented in FIG. 6. The method comprises S10 recirculating exhaust gas from the exhaust gas system 16 to the intake system 18 via at least one of the first and second exhaust gas recirculation paths 24, 26. Moreover, the method further comprises S12 controlling the flow volume of exhaust gas through at least one of the first and second exhaust gas recirculation paths 24, 26.

As a non-limiting example, the method may comprise determining a power system characteristic parameter and controlling the flow volume of exhaust gas through at least one of the first and second exhaust gas recirculation paths in response to the power system characteristic parameter.

Figure 7:
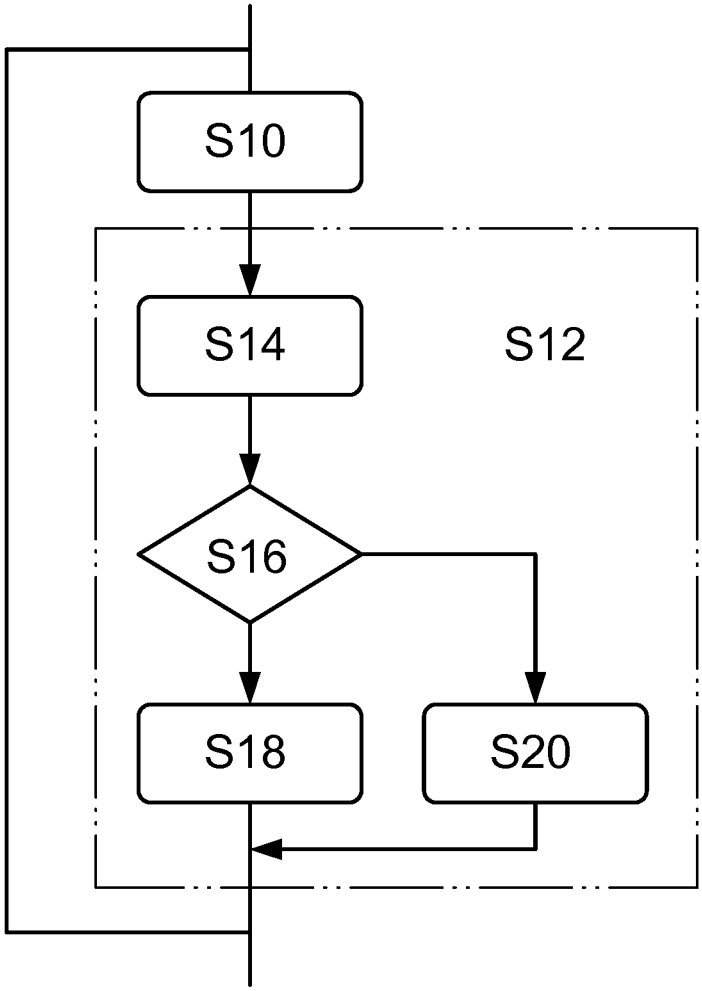
FIG. 7 is a flow chart of another embodiment of a method of the invention.

To this end FIG. 7 dins rates an embodiment of a method according to the present invention. As for the FIG. 6 method, the FIG. 7 method also comprises S10 recirculating exhaust gas from the exhaust gas system 16 to the intake system 18 via at least one of the first and second exhaust gas recirculation paths 24, 26. Moreover, in the FIG. 7 embodiment, the feature S12 of controlling, the flow volume of exhaust gas through at least one of the first and second exhaust gas recirculation paths 24, 26 comprises a plurality of features.

To this end, the FIG. 7 embodiment comprises S14 determining a power system characteristic parameter. Purely by way of example, the power system characteristic parameter may be indicative of at least the temperature of the internal combustion engine 14 and/or the liquid content of the exhaust gas produced by the internal combustion engine 14 and/or the liquid content in fluid removed from the exhaust gases.

The FIG. 7 method further comprises S16 a feature of evaluating the power system characteristic parameter thus determined and thereafter selecting an appropriate control of the flow volume of exhaust gas through at least one of the first and second exhaust gas recirculation paths 24, 26.

As a non-limiting example, the power system characteristic parameter may be indicative of the likelihood of formation of liquid in a portion of the power system. Purely by way of example, the feature S16 may comprise determining a likelihood of formation of liquid in a portion of the power system, preferably M a liquid separator and/or in a drain conduit of the power system, using the power system characteristic parameter.

Irrespective of the information associated with the power system characteristic parameter, the S16 feature of FIG. 7 also determines which one of the flow volume control strategies in features S18 or S20 to employ.

As a non-limiting example, the flow volume control strategy in feature S18 may be a control such that a major portion, e.g., at least 80%, preferably at least 90%, more preferred 100%, of the exhaust gas flows through the first exhaust gas recirculation path 24 and the remaining portion of the exhaust gas flows through the second exhaust gas recirculation paths 26.

Moreover, as a non-limiting example, the flow volume control strategy in feature S20 may be a control such that a major portion, e.g. at least 80%, preferably at least 90%, more preferred 100%, of the exhaust gas flows through the second exhaust gas recirculation path 26 and the remaining portion of the exhaust gas flows through the first exhaust gas recirculation paths 26.

Thus, if the power system characteristic parameter for instance is indicative of a relatively large likelihood of formation of liquid in a portion of the power system, the FIG. 7 method may employ the flow volume control strategy in feature S18. Purely by way of example, the FIG. 7 method may comprise employing the control strategy in feature S18, for instance by closing the flow through the second exhaust gas recirculation path 26, if the likelihood of formation of liquid in a portion of the power system exceeds a predetermined threshold level.

On the other hand if a low likelihood of formation of liquid in a portion of the power system is determined, feature S16 may select the flow volume control strategy in feature S20.

Moreover, in relation to e.g. the embodiment disclosed in relation to FIG. 3 hereinabove, an embodiment of the method may further comprise draining ret oved from the exhaust gases to a drain outlet 60 located in the exhaust gas system. Such a method may further comprise controlling the exhaust gas pressure upstream the drain outlet 60 such that the exhaust gas pressure exceeds the pressure at the drain outlet by a predetermined amount.

Additionally, the exhaust gas system 16 may comprise an exhaust pressure governor 68 and the intake system 18 comprises an intake flow control valve 74, such as in the FIG. 3 embodiment presented hereinabove, wherein a predetermined exhaust recirculation flow is achieved by a combined governing of the exhaust pressure governor 68 and the intake flow control valve 74. The combined governing is controlled for achieving a fuel consumption below a predetermined fuel consumption level.

It is to be understood that the present invention is not limited to the embodiments, described above and illustrated in the drawings; rather, the skilled person will recognize that many changes and modifications may be made within the scope of the appended claims.

For instance, the present invention may be used to assist operation of the power system on more than one fuel type. As is known, operation of diesel engines on Dymethyl Ether fuel is advantageous in many ways, not least due to virtual impossibility of forming soot particles of relatively large sizes as is common when ordinary diesel oil fuel is used. Nevertheless, it may also be necessary/convenient to operate a DME-fuelled engine/vehicle on such diesel oil fuel for a limited time, for example when DME is not available. When the engine employs no EGR or a shoe-route EGR system, in which recirculated exhaust gas is taken upstream of the turbine part of the turbocharger and fed into the intake downstream of the compressor part of the turbocharger, operating the DME engine on fuels like diesel oil, naphtha and the like can be quite straightforward. This has been proven by Volvo in 2013 when naphtha was filled into the DME fuel tank of a truck designed for operating on DME as single fuel, and the truck was then run a considerable distance without introducing any changes to its design or the electronic controls, then naphtha was emptied out and trouble-free operation on DME continued without any cleaning or maintenance. However, when the engine is equipped with a long-route EGR system, the soot that is formed operating on diesel fuel, could inflict damage on the compressor impeller blades. To prevent this, valve 34 can be closed such that soot is not fed into the intake of the compressor via the second flow path 26 when the blades are exposed to erosion. By way of an example, a special "limp-home" dataset could be provided in the engine control module, which can be activated for a safer operation of the engine and for protecting the environment from excessive pollution by exhaust gases when such different fuel is detected.

The invention claimed is:

1. An exhaust gas recirculation arrangement for a power system, the power system comprising an internal combustion engine, an exhaust gas system and an intake system comprising an inlet air compressor, the exhaust gas recirculation arrangement comprising a first exhaust gas recirculation path and a second exhaust gas recirculation path for recirculating exhaust gas from the exhaust gas system to the intake system, wherein:

the first and second exhaust gas recirculation paths are non-identical and adapted to recirculate exhaust gas to an upstream side of the inlet air compressor, in an intended direction of flow of inlet air in the power system;

in use, the first exhaust gas recirculation path is associated with a first liquid removal capability and the second exhaust gas recirculation path is associated with a second liquid removal capability, the first liquid removal capability being higher than the second liquid removal capability; and the exhaust gas recirculation arrangement comprises a flow controller, wherein the flow controller comprises a valve connected to the second exhaust gas recirculation path, for controlling the flow volume through at least one of the first and second exhaust gas recirculation paths.

2. The exhaust gas recirculation arrangement according to claim 1, wherein the exhaust gas recirculation arrangement comprises a sensor adapted to determine a power system characteristic parameter, the exhaust gas recirculation arrangement being adapted to control the flow controller in response to the power system characteristic parameter.

3. The exhaust gas recirculation arrangement according to claim 2, wherein the power system characteristic parameter is indicative of at least the temperature of the internal combustion engine and/or the liquid content in the exhaust gas produced by the internal combustion engine and/or the liquid content in fluid removed from the exhaust gases by the exhaust gas recirculation arrangement.

4. The exhaust gas recirculation arrangement according to claim 1, wherein the exhaust gas recirculation arrangement comprises a liquid separator comprising a first and a second gas outlet, the first gas outlet being in fluid communication with the first exhaust gas recirculation path and the second gas outlet being in fluid communication with the second exhaust gas recirculation path.

5. The exhaust gas recirculation arrangement according to claim 3, wherein first and second exhaust gas recirculation paths are non-identical wherein, in use, the first exhaust gas recirculation path is associated with a first liquid removal capability and the second exhaust gas recirculation path is associated with a second liquid removal capability, the first liquid removal capability being higher than the second liquid removal capability, wherein the exhaust gas recirculation arrangement comprises a liquid separator comprising a first and a second gas outlet, the first gas outlet being in fluid communication with the first exhaust gas recirculation path and the second gas outlet being in fluid communication with the second exhaust gas recirculation path, and wherein the liquid separator comprises a liquid collecting portion and the sensor is located in the liquid collecting portion.

6. The exhaust gas recirculation arrangement according to claim 4, wherein the liquid separator comprises a labyrinth section comprising an interior labyrinth portion in fluid communication with the first gas outlet.

7. The exhaust gas recirculation arrangement according to claim 4, wherein the exhaust gas recirculation arrangement comprises an exhaust gas recirculating conduit adapted to fluidly connect a recirculation inlet, connectable to the exhaust gas system, to the liquid separator.

8. The exhaust gas recirculation arrangement according to claim 7, wherein the exhaust gas recirculation arrangement comprises an exhaust gas recirculating cooler located between the recirculation inlet and the liquid separator, as seen in a direction of flow from the recirculation inlet to the liquid separator.

9. The exhaust gas recirculation arrangement according to claim 4, further comprising a separator drain conduit adapted to provide a fluid communication between the liquid separator and a drain outlet, connectable to the exhaust gas system, the drain outlet being adapted to be located downstream the recirculation inlet in an intended direction of exhaust gas flow in the exhaust gas system.

10. The exhaust gas recirculation arrangement according to claim 9, wherein the separator drain conduit comprises a restrictor, preferably the restrictor having a flow restriction being at least twice the restriction of the first exhaust gas recirculation path.

11. The exhaust gas recirculation arrangement according to claim 9 or claim 10, when dependent on claim 3, wherein the sensor is located in the separator drain conduit.

12. The exhaust gas recirculation arrangement according to claim 9, further comprising a drain check valve for allowing drain flow from the liquid separator to the drain outlet and preventing flow in the opposite direction.

13. The exhaust gas recirculation arrangement according to claim 1, wherein the inlet air compressor comprises a radial centre, the first exhaust gas recirculation path being adapted to discharge exhaust gas towards the radial centre.

14. The exhaust gas recirculation arrangement according to claim 13, wherein the inlet air compressor comprises a receiving area exposable to inlet air, the first exhaust gas recirculation path being adapted to discharge exhaust gas towards a limited portion, preferably 30% or less, more preferred 15% or less, of the receiving area.

15. A power system comprising an internal combustion engine and an exhaust gas recirculation arrangement according to claim 1.

16. The power system according to claim 15, further comprising the exhaust gas system, wherein exhaust gas is adapted to be fed from an exhaust gas feeding portion of the exhaust gas system to the exhaust gas recirculation arrangement, the exhaust gas system further comprising an exhaust pressure governor located downstream of the exhaust gas feeding portion.

17. The power system according to claim 16, wherein the exhaust gas system comprises a liquid receiving portion adapted to receive liquid separated by the exhaust gas recirculation arrangement, the liquid receiving portion being located downstream of the exhaust pressure governor.

18. The power system according to claim 15, comprising the intake system, the intake system comprising an exhaust gas receiving portion adapted to receive exhaust gas from the first and second exhaust gas recirculation paths, the intake system further comprising an intake flow control valve located upstream the exhaust gas receiving portion.

19. A vehicle comprising the exhaust gas recirculation arrangement according to claim 1.

20. A method for recirculating exhaust gas to an air intake of a power system comprising an internal combustion engine, an exhaust gas system and an intake system comprising an inlet air compressor, using a first exhaust gas recirculation path and a second exhaust gas recirculation path, each one of the first and second exhaust gas recirculation paths being adapted to return exhaust gas to an upstream side of the inlet air compressor, the method comprising:

a. recirculating exhaust gas from the exhaust gas system to the intake system via at least one of the first and second exhaust gas recirculation paths;

characterized by b. selectively controlling the flow volume of exhaust gas through either one, or both, of the first and second exhaust gas recirculation paths, wherein the first exhaust gas recirculation path is associated with a first liquid removal capability and the second exhaust gas recirculation path is associated with a second liquid removal capability, the first liquid removal capability being higher than the second liquid removal capability.

21. The method according to claim 20, wherein the method further comprises:

a. determining a power system characteristic parameter and b. controlling the flow volume of exhaust gas through at least one of the first and second exhaust gas recirculation paths in response to the power system characteristic parameter.

22. The method according to claim 21, wherein the power system characteristic parameter is indicative of at least the temperature of the internal combustion engine and/or the liquid content of the exhaust gas produced by the internal combustion engine and/or the liquid content in fluid removed from the exhaust gases.

23. The method according to claim 21, wherein the method further comprises determining a likelihood of formation of liquid in a portion of the power system, preferably in a liquid separator and/or in a drain conduit of the power system, using the power system characteristic parameter.

24. The method according to claim 20, wherein the method further comprises determining a likelihood of formation of liquid in a portion of the power system, preferably in a liquid separator and/or in a drain conduit of the power system, using the power system characteristic parameter, and wherein the method further comprises closing the flow through the second exhaust gas recirculation path if the likelihood of formation of liquid in a portion of the power system exceeds a predetermined threshold level.

25. The method according to claim 20, wherein the method further comprises draining liquid removed from the exhaust gases to a drain outlet located in the exhaust gas system, the method further comprises controlling the exhaust gas pressure upstream the drain outlet such that the exhaust gas pressure exceeds the pressure at the drain outlet by an predetermined amount.

26. The method according to claim 20, wherein the exhaust gas system comprises an exhaust pressure governor and the intake system comprises an intake flow control valve, wherein a predetermined exhaust recirculation flow is achieved by a combined governing of the exhaust pressure governor and the intake flow control valve, wherein the combined governing is controlled for achieving a fuel consumption below a predetermined fuel consumption level.

27. A computer comprising a computer program for performing the steps of claim 20 when the program is run on the computer.

28. A non-transitory computer readable medium carrying a computer program for performing the steps of claim 20 when the program product is run on a computer.

29. A control unit for controlling exhaust gas recirculation to an air intake of a power system, the control unit being configured to perform the steps of claim 20.

30. A method for recirculating exhaust gas to an air intake of a power system comprising an internal combustion engine, an exhaust gas system, and an intake system comprising an inlet air compressor, wherein the exhaust gas system comprises an exhaust pressure governor and the intake system comprises an intake flow control valve, the method comprising:

using a first exhaust gas recirculation path and a second exhaust gas recirculation path, each one of the first and second exhaust gas recirculation paths being adapted to return exhaust gas to an upstream side of the inlet air compressor;

achieving a predetermined exhaust recirculation flow by a combined governing of the exhaust pressure governor and the intake flow control valve, and wherein the combined governing is controlled for achieving a fuel consumption below a predetermined fuel consumption level;

recirculating exhaust gas from the exhaust gas system to the intake system via at least one of the first and second exhaust gas recirculation paths; and selectively controlling the flow volume of exhaust gas through either one, or both, of the first and second exhaust gas recirculation paths.

* * * * *